US009302474B2

(12) United States Patent
Koerner et al.

(10) Patent No.: US 9,302,474 B2
(45) Date of Patent: Apr. 5, 2016

(54) METHOD TO CONTROL VIBRATION MEASURES AND REFRESH MEASURES IN PRINTING OPERATION OF AN INK PRINTING SYSTEM WITH AT LEAST ONE PRINTING APPARATUS

(71) Applicant: Oce Printing Systems GmbH & Co. KG, Poing (DE)

(72) Inventors: Philippe Koerner, Munich (DE); Harald Myllek, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/707,072

(22) Filed: May 8, 2015

(65) Prior Publication Data

US 2015/0321472 A1 Nov. 12, 2015

(30) Foreign Application Priority Data

May 8, 2014 (DE) ..... 10 2014 106 424

(51) Int. Cl.
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 2/04541; B41J 2/04588; B41J 2/04596; B41J 2/04573
See application file for complete search history.

(56) References Cited

U.S. PATENT DOCUMENTS

| | | | | |
|---|---|---|---|---|
| 5,767,888 | A | 6/1998 | Schleusener et al. | |
| 6,431,674 | B2 | 8/2002 | Suzuki et al. | |
| 8,342,628 | B2 * | 1/2013 | Ito et al. | 347/14 |
| 2012/0262510 | A1 | 10/2012 | Komazawa et al. | |
| 2014/0176629 | A1 | 6/2014 | Buschmann | |

FOREIGN PATENT DOCUMENTS

| | | | |
|---|---|---|---|
| DE | 697 36 991 | T2 | 7/2007 |
| DE | 102012110187 | A1 | 4/2014 |
| EP | 0788882 | B1 | 7/2002 |
| EP | 1795356 | A1 | 6/2007 |
| WO | 94/18786 | A1 | 8/1994 |

* cited by examiner

*Primary Examiner* — Thinh Nguyen
(74) *Attorney, Agent, or Firm* — Schiff Hardin LLP

(57) ABSTRACT

In a method to control vibration measures and refresh measures in a printing operation of an ink printing system with at least one printing apparatus, the printing apparatus having printing elements that fire ink droplets as print dots at a printing substrate depending on control data determined from print data associated with print images and firing pause information about firing pauses for the printing elements. Prefire data and refresh data derived from the firing pause information and from operating condition information of the printing apparatus are combined with the control data. The vibration measures and refresh measures are executed by the printing elements depending on the firing pause information, the prefire data, and the refresh data, no ink droplets being ejected during the vibration measures and ink droplets being ejected during the refresh measures.

10 Claims, 5 Drawing Sheets

METHOD TO CONTROL VIBRATION MEASURES AND REFRESH MEASURES IN PRINTING OPERATION OF AN INK PRINTING SYSTEM WITH AT LEAST ONE PRINTING APPARATUS

BACKGROUND

Ink printing apparatuses can be used for single-color or multicolor printing of a printing substrate, for example of a single sheet or of a web-shaped recording medium made of the most varied materials (paper, for example). The design of such ink printing apparatuses is known; see for example EP 0 788 882 B1. Ink printing apparatuses that operate according to the Drop-on Demand (DoD) principle have a print head or multiple print heads that provide a plurality of printing elements. A printing element thereby comprises an ink channel ending in a nozzle, which ink channel has a piezoactivator. The activators—controlled by a printer controller via control signals developed from control data—excite ink droplets in the direction of the printing substrate, which ink droplets are directed onto the printing substrate in order to apply print dots for a print image there.

The control data with the control signals are obtained in a preparation process from the print data derived from the image to be printed. In this preparation process, with an RIP (Raster Image Processor) the image to be printed is overlaid with a print image raster, wherein a raster point of the print image raster respectively corresponds to a PEL or output pixel. A PEL is the location at which a print dot can be applied. In order to also be able to reproduce grey tones (semitones) in the print image, multiple raster points or PELs can be combined into a print raster cell that is filled with more or fewer print dots depending on the grey value of the print image (WO 94/18786 A1). Before this process runs in the printer, for the printer a print job is developed in which, for example, the type of rastering can be established by adjusting the printer driver options.

In an inkjet printing apparatus, the ink that is used is adapted to the print head in terms of its physical/chemical composition; for example, the ink is adapted in terms of its viscosity. Given low print utilization, not all printing elements of the print head are activated in the printing process. Many printing elements have downtimes, with the consequence that the ink in the ink channels of these printing elements is not moved. Due to the effect of the evaporation out of the nozzle opening, the danger exists that the viscosity of the ink is then altered. This has the consequence that the ink in the ink channel can then no longer move optimally and exit from the nozzle. In extreme cases, the ink in the ink channel dries completely and clogs the ink channel, such that a printing with this nozzle is no longer possible.

A drying of the ink in the printing elements of a print head in their print pauses represents a problem that can be prevented in that a flushing medium (for example ink or cleaning fluid) is flushed through all nozzles of the print head within a predetermined cycle. This flushing cycle can be set corresponding to the print utilization.

The drying of the ink in the nozzles can also be prevented in that printing occurs from all nozzles within a predetermined cycle (refresh measure). This cycle can be set corresponding to the print utilization. Individual points can thereby be applied in unprinted regions of the printing substrate, or print dot lines can be printed between print pages. These methods can lead to disruptions in the print image, in addition to unnecessary ink consumption and additional wear of the print heads. A corresponding refresh measure for an ink printing apparatus is described in US 2012/0 262 510 A1.

Furthermore, from DE 697 36 991 T2 (EP 0 788 882 B1) it is known to remedy the difficulties in the ejection of ink droplets that are caused by alteration of the viscosity of the ink in the nozzles, in that before or after a printing process the piezoelectric activators of the printing elements are respectively set into vibration (also called a prefire measure or meniscus oscillations) such that no ink droplets are ejected, but the ink in the ink channels and nozzles is stirred. It can thereby be achieved that the ink situated in the nozzle openings mixes with the ink located inside the ink channel, such that in the printing operation the ink droplets can again be generated under normal conditions.

From EP 1 795 356 A1, during printing pauses of printing elements of a print head it is known to insert vibration oscillations for these printing elements to avoid the drying of the ink. A printing pause for a printing element is provided if no ink droplets should be ejected with this printing element in the printing operation, thus if what are known as "zero pixels" are present. Via the printer controller, the print data are examined as to whether a multitude of such "zero pixels" follow one another for the printing element. If this is the case, one or more vibration oscillations are triggered. The triggering can be controlled via a print clock pulse.

DE 10 2012 110 187 A1 describes a method to execute an interruption in a printing interruption of an ink printing system in which the respective print image is generated by nozzles of the print head from image points arranged like a raster. Given triggering of a printing interruption, the feed velocity of the printing substrate is reduced from the velocity in the printing operation to a predetermined velocity in a slow-down ramp, and is accelerated again to print velocity in an acceleration ramp after the printing interruption. With the aid of a sensor, print clock pulses are generated from the feed of the printing substrate, which print clock pulses are supplied to a printer controller. Given the occurrence of a print clock pulse during the ramps, the printer controller induces a vibration cycle at nozzles of the print head that do not eject ink droplets.

SUMMARY

It is an object to specify a method that ensures that a change of the viscosity of the ink in the printing elements of a print head (in particular at their nozzle openings) that could prevent the ejection of ink droplets is avoided.

In a method to control vibration measures and refresh measures in a printing operation of an ink printing system with at least one printing apparatus, the printing apparatus having printing elements that fire ink droplets as print dots at a printing substrate depending on control data determined from print data associated with print images and firing pause information about firing pauses for the printing elements. Prefire data and refresh data derived from the firing pause information and from operating condition information of the printing apparatus are combined with the control data. The vibration measures and refresh measures are executed by the printing elements depending on the firing pause information, the prefire data, and the refresh data, no ink droplets being ejected during the vibration measures and ink droplets being ejected during the refresh measures.

DESCRIPTION OF EXEMPLARY EMBODIMENTS

Figure 1:
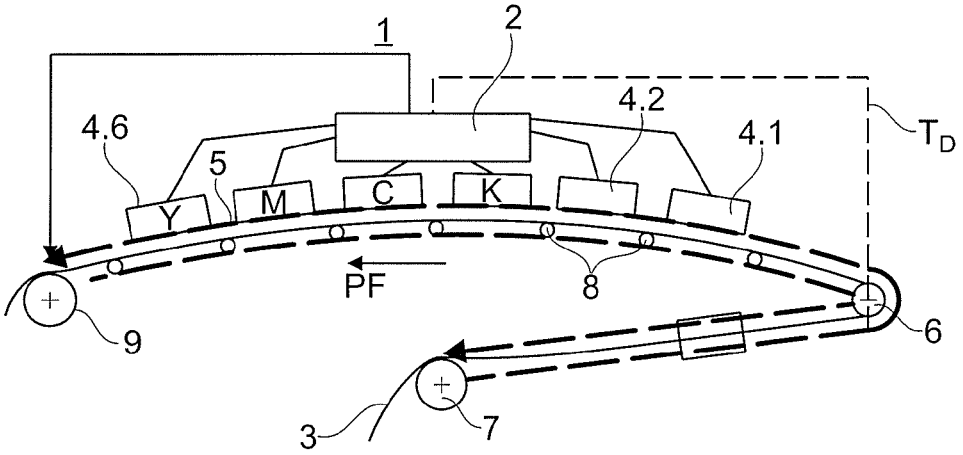
FIG. 1 is a depiction of a printing unit of an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In the method to control vibration cycles in printing operation of an ink printing system with at least one printing apparatus in which the printing apparatus has printing elements that fire ink droplets at a printing substrate depending on control data, the control data for the printing elements are developed in a preparation process in process steps from print data associated with the print images. Selectable information about firing pauses for the printing elements can be derived in the respective process step or at the end of a respective process step. Prefire data can be obtained from this information and from additional information about operating conditions of the printing apparatus and can be inserted into the control data, wherein vibration cycles are executed by the printing elements in their firing pauses depending on the prefire data.

The following advantages can be achieved with the method according to a first exemplary embodiment:

- an improvement of the print quality during continuous printing (print dot positioning);
- no dried nozzles, and thus no loss of image information;
- an optimized and targeted utilization of the vibration oscillations, and therefore a minimized print head heating due to the movement of the activators and less print head aging;
- a higher productivity of the printing apparatus due to shorter service intervals;
- a reduced ink consumption due to no or a reduced number of refresh measures;
- no or less load in the print image due to printed refresh measures; and
- simplification of the post-processing by avoiding refresh lines.

The following points can be taken into account for the adjustment and distribution of prefire data in the data series of the control data, for example:

- an optimization with regard to unknown data of the next print page;
- a setting of the calculated prefire measures across multiple print pages;
- a point to be printed always has priority over a prefire measure and refresh measure; and
- a refresh measure should have priority over a prefire measure.

The following advantages result given a printing interruption:

- the reliability of the printing is increased during the ramping, i.e. during the slow-down and acceleration ramps, and no data loss occurs;
- printing during the ramps is possible with inks that dry quickly; and
- the exemplary embodiment can be realized with little expenditure.

The exemplary embodiments are explained further using schematic FIGS. 1 through 10.

According to FIG. 1, a printing unit 1 and a printer controller 2 of a printing apparatus DR are shown. Arranged along a printing substrate web 3 is the printing unit 1 that has print bars 4 with print heads 5 in series (as viewed in the transport direction PF of the printing substrate web 3, wherein the print heads 5 respectively provide printing elements with nozzles via which ink droplets can be ejected. Given color printing, a respective print bar 4 can be provided per color to be printed, for example. With the aid of a take-off roller 9, the printing substrate web 3 is moved past the print bars 4; and the printing substrate web 3 thereby lies on a saddle with guide rollers 8. At the intake of the printing unit 1, a sensor 6 is arranged that generates print clock pulses $T_D$ depending on the feed movement of the printing substrate web 3, which print clock pulses $T_D$ are supplied to the printer controller 2 and are used by said printer controller 2 in order to establish the point in time of the ejection of ink droplets at the nozzles of the individual print heads 5, for example. The sensor can be executed as a rotary pulse generator roller or encoder roller 6 that is driven by the printing substrate web 3, for example.

According to FIG. 1, the print clock pulses $T_D$ are thus generated by the encoder roller 6 synchronously with the feed of the printing substrate web 3, which means that one print clock pulse $T_D$ is emitted by the encoder roller 6 to the printer controller 2 per output pixel or PEL to be printed, for example. After each print clock pulse $T_D$, this printer controller 2 can supply print data to the respective print head 5 and then trigger the dispensing of ink droplets. The print heads 5 have printing elements made up (in the known manner) of nozzles, ink channels and activators, wherein the printing elements can generate ink droplets with a piezoelectric activator according to the DoD principle, for example, which ink droplets are deflected towards the printing substrate web 3 in order to generate an inked print dot there. The printing substrate web 3 is thereby supplied to the encoder roller 6 via a driver roller 7 arranged before the encoder roller 6.

Figure 2:
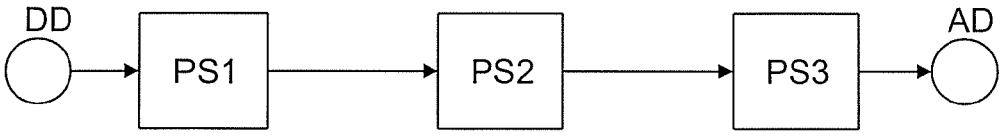
FIG. 2 is a depiction of the preparation process of the print data into the control data.

FIG. 2 shows a workflow diagram that depicts the principle of the preparation process of the print data DD into the control data AD for the printing elements of a print head 5 given a print order for images to be printed. From the print order, a print job required for setting the printer is developed that also includes the print data DD (first process step PS1). The images to be printed are then translated with the aid of an RIP generator into a print image raster that respectively provides one raster point per PEL or output pixel (second process step PS2). In order to be able to print grey tones, multiple raster points are assembled into a respective raster cell, wherein more or fewer raster points of the raster cell have a print dot depending on the grey tone. In a screening process, the control data for the printing elements of the print head can then be derived from this print raster (third process step PS3).

At different points of this preparation process, information are derived about the necessity of the insertion of prefire measures that provide prefire data for the insertion of at least one vibration cycle with vibration oscillations into the control data series AD, and about the necessity of the insertion of refresh measures that provide refresh data for the insertion of at least one refresh cycle into the control data series.

The earlier in the preparation process that this test is implemented, the more general that this information is, or the more print data-independent it is of the necessity for prefire measures or refresh measures, since then the order of print dots is not yet known. Here information can then be obtained from the environment conditions of the printing apparatus or from the operating conditions for the printing apparatus 1, for example from the printing speed, from printing pauses, from the ink that is used, from the print head type, from the page length, from the quality of the print image, etc. In contrast to this, information about the series of print dots (called print dot data in the following) for the printing elements is known after the rastering process (2nd process step PS2) or the screening process (3rd process step PS3), such that it is apparent whether a printing element has a firing pause or multiple firing pauses in series. Prefire data or refresh data can then be specifically inserted into the control data AD, between the print dot data. However, information about environment conditions or operating conditions for the printing apparatus 1 can also be taken into account here.

In the preparation process, print data DD are thus converted into print dot data via rastering and screening; and the print dot data specify with which printing elements the print image should be created. Prefire data for vibration measures and refresh data for refresh measures can be inserted into the series of print dot data. The control data AD for the printing elements of the print head 4 yield the order of print dot data, prefire data and refresh data. If print dot data or refresh data are supplied to a printing element, the activator of the printing element induces the ejection of an ink droplet; and in contrast to this, if prefire data are supplied to the printing element, the activator induces vibration oscillations in the ink channel and the nozzle of the printing element without ink droplets being fired.

Prefire measures or refresh measures can therefore be derived in the following process steps PS:

during or after the print job creation (process step PS1);

during or after the RIP process (rastering of the image to be printed; process step PS2); and during or after the screening process (derivation of the print dot data for the printing elements; process step PS3).

Figure 3:
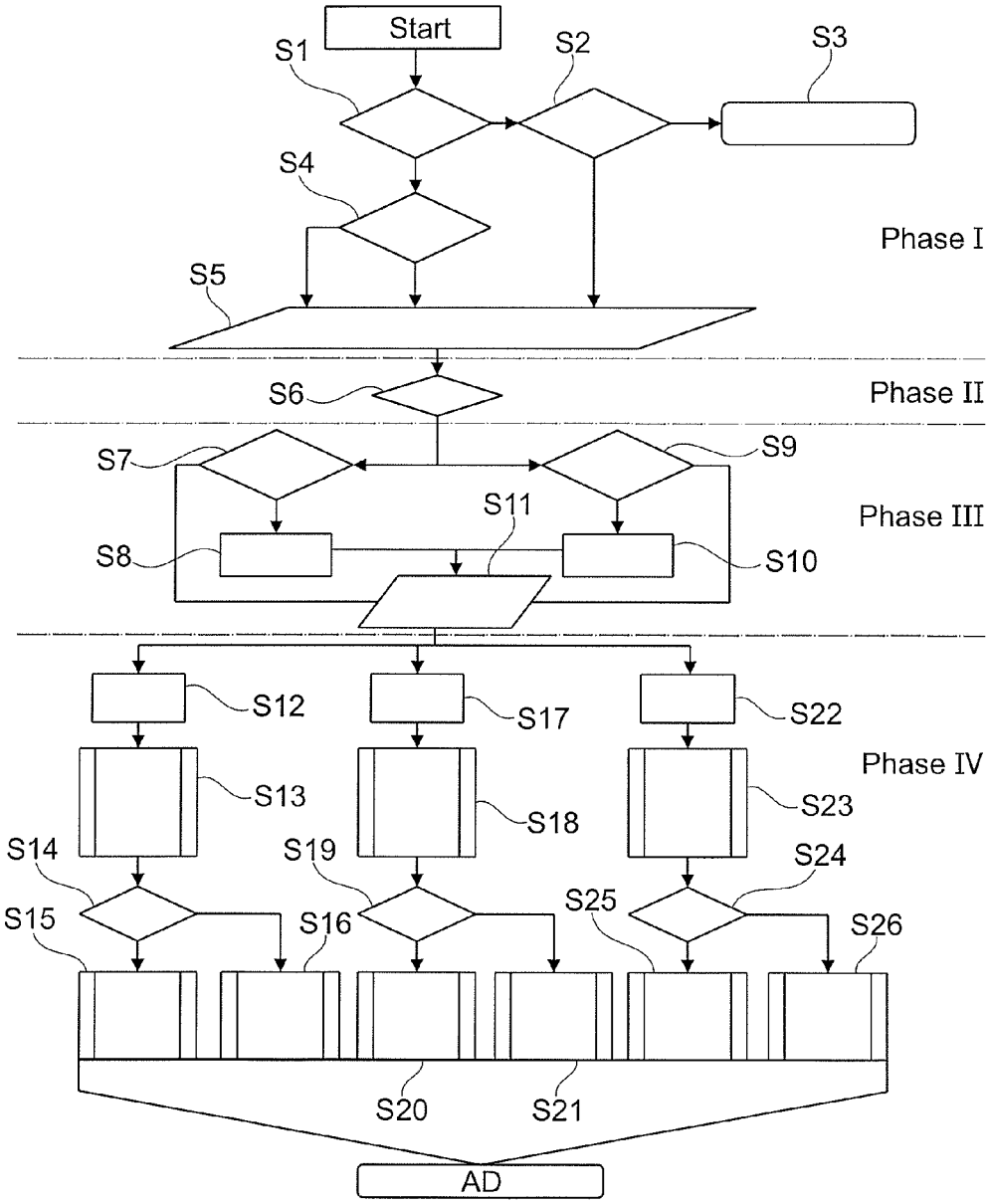
FIG. 3 is a first workflow diagram that depicts the series of steps from the print data to the control data under consideration of refresh measures and prefire measures.

FIG. 3 shows a first exemplary embodiment for the derivation of control data AD. Here a method is specified in which prefire measures are implemented without consideration of the real data to be printed in continuous printing. In the generation of the print job, a method that, for example, is dependent on the following components:

the print head type;

the environment climate of the printing apparatus;

the print speed of the printing apparatus;

the pause function in the printing operation; and the quality requirements for the print image can be selected for the distribution of prefire measures in the data series of print dot data. The prefire measures are thereby independent of the print data.

An optimized combination of prefire measures and refresh measures can thereby also be implemented with the goal of reducing the number of refresh measures, wherein it can be taken into account (for example) that refresh measures can be necessary in order to compensate for a loss of solvent in the ink.

A workflow diagram for the depicted method can be learned from FIG. 3:

Phase I of the Method.

Query: should prefire measures be implemented?

In step S1 a query is made as to whether a prefire measure should be implemented. If this is not the case, in step S2 it is queried whether a refresh measure is to be implemented. If this is not the case, the print image can be printed (step S3). If it is established in step S1 that a prefire measure is to be implemented, in step S4 it is furthermore examined whether a refresh measure is additionally to be executed or not. Depending on the result of this query, the information for the prefire measure are used alone or in combination with the refresh measure (step S5).

Phase II of the Method.

At what point of the preparation process should information regarding the prefire and/or refresh measures be derived?

In FIG. 3, this should take place in the print job creation (step S6).

Phase III of the Method.

Should the prefire measures or refresh measures be dependent on the print data?

In step S7 it is tested whether the prefire measures should be dependent on print data or not. If the prefire measures should not be print data-dependent, in step S8 the print data are requested and in step S11 these are combined with the prefire data. Otherwise, the method transitions to the next phase IV. The same workflow applies for the question as to whether refresh measures should be independent of the print data (step S9). If this is not the case, the print data are loaded (step S10) and combined with the refresh data (step S11). If it is the case, the method transitions to phase IV.

Phase IV of the Method.

Create the data series from print dot data, prefire data and/or refresh data.

In Phase IV, three workflows are differentiated:

1st Workflow:

Create the control data series for the print head from print data and prefire data (branch 512).

It is established which print data-independent information should be taken into account, for example operating data or environment data for the printing apparatus (step S13). Should print data-dependent information be incorporated as well (step S14)? If this is the case, the control data series is formed from both prefire data types and the print data (step S15); otherwise, the data stream is formed from the print data-independent prefire data and the print data (step S16).

2nd Workflow:

Create the data series for the print head from print data and refresh data (branch S17).

It is established which print data-independent information should be taken into account (step S18). Should print data-dependent information be incorporated as well (step S19)? If this is the case, the control data series is formed from both refresh data types and the print data (step S20); otherwise, the data stream is formed from the print data-independent refresh data and the print data (step S21).

3rd Workflow:

Create the data series for the print head from print data, refresh data and prefire data (branch S22).

It is established which print data-independent information should be taken into account (step S23). Should print data-dependent information be incorporated as well (step S24)? If this is the case, the control data series is formed from both prefire and refresh data types and the print data (step S25); otherwise, the data stream is formed from the print data-independent prefire and refresh data and the print data (step S26).

Figure 4:
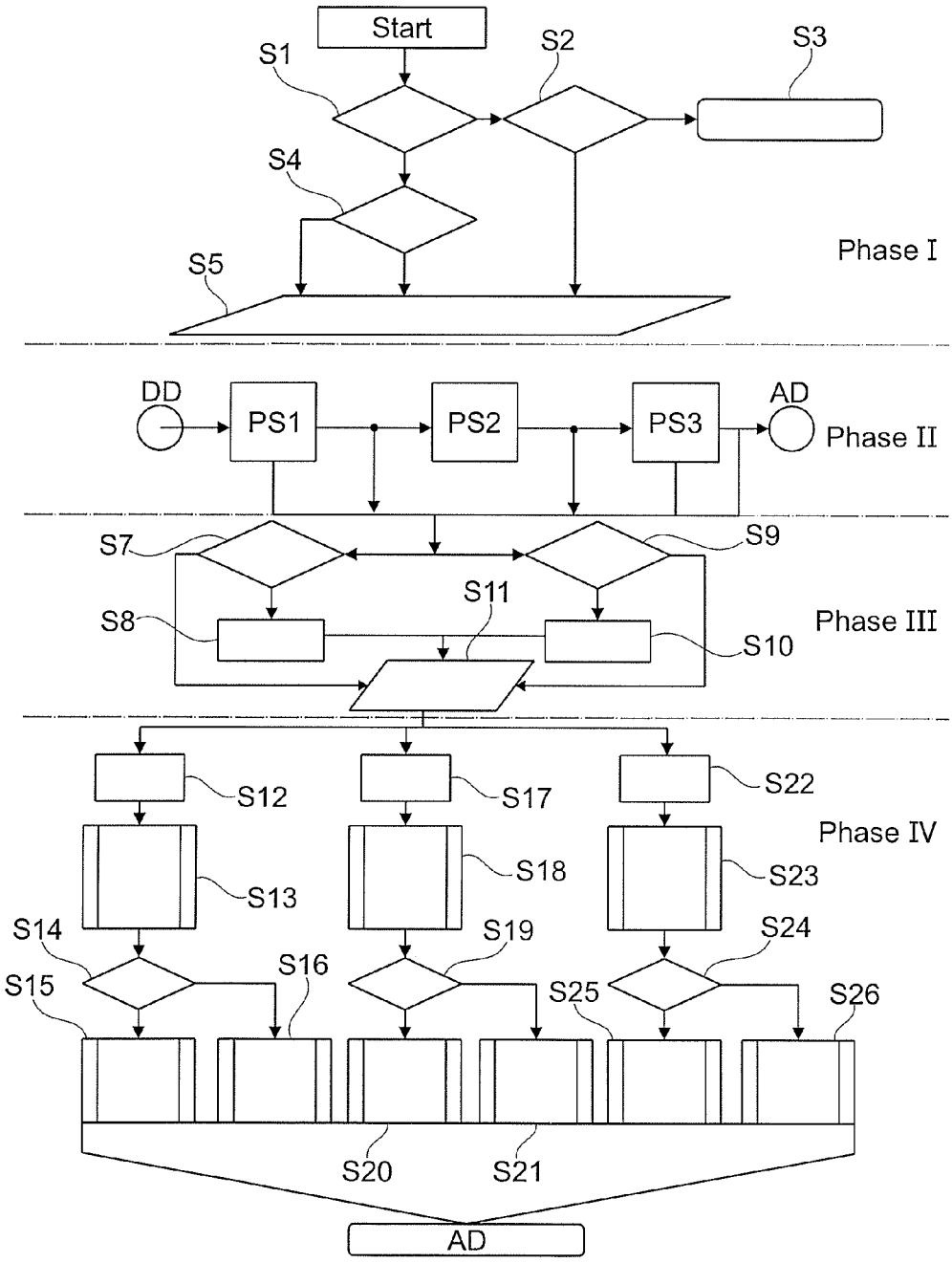
FIG. 4 is a second workflow diagram that depicts the series of steps from the print data to the control data under consideration of refresh measures and prefire measures.

The workflow according to FIG. 3 can be accordingly transferred to the cases in which information for the control data can be obtained at other points (process steps PS) in the preparation process. This situation is shown in general in FIG. 4. FIG. 4 differs from FIG. 3 only in that the possible points in the preparation process at which information about prefire measures and/or refresh measures can be derived are indicated in Phase II, in step S6. The information can respectively be derived in the process step PS or after the respective process step PS. Refer in this regard to the statements regarding FIG. 3.

In the following, three exemplary embodiments are explained for the application of the method for the creation of the control data AD for the printing elements of a print head 5.

Figure 5:
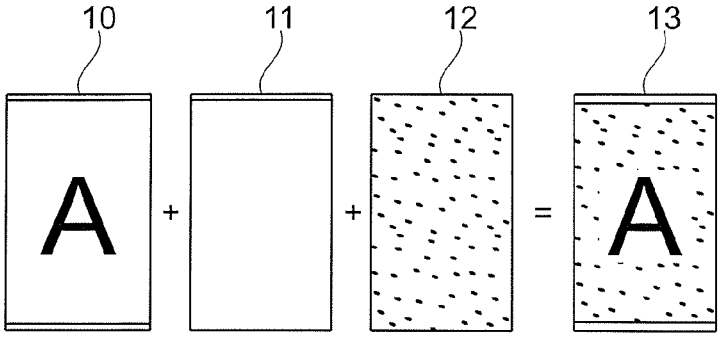
FIG. 5 is a development of the control data for the printing elements via a combination of a prefire matrix and a refresh matrix with a print image raster.

First Exemplary Embodiment, FIG. 5

FIG. 5 now shows how, without knowledge of the print image and the print data, prefire measures and refresh measures can be combined with an image to be printed in order to arrive at a print image in whose print workflow prefire measures are scattered and refresh measures are additionally implemented. The letter "A" should be printed. Without considering the print data 10 for the print character "A", a prefire matrix 11 is provided as a prefire measure and a refresh matrix 12 is additionally provided as a refresh measure. These matrices 11, 12 are combined with the print character raster 10 in order to generate the data series for the control data AD for the printing elements that then print the print image. In the print image raster 13 it is specified at which raster point a print dot should be generated, at which raster point a prefire measure is to be implemented and at which raster point a refresh measure is to be implemented. It is thereby to be taken into account that print dots for print data precede (have a higher priority than) prefire measures and refresh measures or that refresh measures precede prefire measures. In the print image 13 itself care is to be taken that prefire measures are not detectable. In the example print image 13, the print dots for the letter "A" and refresh points would then be detectable on a printing substrate 3. In FIG. 5, the refresh points are shown strongly exaggerated in the refresh matrix 12 and the print image 13. Normally, the refresh points are barely visible in the print image.

Figure 6:
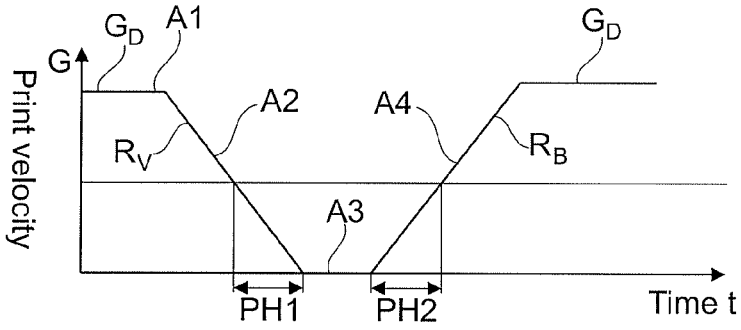
FIG. 6 illustrates the velocity relationships given a printing interruption.

Second Exemplary Embodiment, in Connection with FIG. 1 and FIG. 6

Given printing to a printing substrate 3, it is sometimes necessary to interrupt the printing operation briefly (for example for 3 min), for example in order to monitor the register quality after proofing a print job or in order to remedy problems in the post-processing of the printing substrate 3. The feed velocity of the printing substrate 3 can thereby be reduced in a slow-down ramp $R_V$ up to a complete stop, and be accelerated again in an acceleration ramp $R_B$ after a wait time of (for example) 3 min. Printing can be continued during the time period of the slow-down of the printing substrate 3 before the printing interruption, and during the acceleration of the printing substrate 3 after the printing interruption, wherein the time intervals between the print clock pulses $T_D$ (and therefore between the dispensing of ink droplets) increase or decrease during the ramping. The problem of the drying of the ink in the nozzles of the print heads 5 is then intensified during the duration of the ramps, with the consequence that printing at a sufficient quality can no longer take place.

If the printing operation is interrupted, the problems explained above thus occur during the slow-down and acceleration phase. In both cases, the printing substrate web 3 moves during these phases, with the consequence that the encoder roller 6 emits print clock pulses $T_D$. Print-start signals are then supplied to the respective print heads 5, such that the nozzles of the print head 5 eject ink droplets onto the printing substrate web 3 during further printing if print dots should be generated on the printing substrate web 3 in the print image, while the respective nozzles of the print head 5 are not activated given output pixels of the print image that are not to be inked. However, since the time interval between the print clock pulses $T_D$ become increasingly larger in the phase of the slow-down of the printing substrate web 3 in comparison to the printing operation, the danger exists that the viscosity of the ink in the nozzle openings changes gradually such that ink droplets cannot be generated by the piezoelectric activators without problems. The time interval of the print clock pulses $T_D$ accordingly decreases during the acceleration phase such that, at the beginning of the acceleration, the viscosity of the ink can have changed after the printing interruption such that the ejection of ink droplets from the nozzles of the print heads 5 is disrupted.

Using FIG. 6, the curve of the velocity G of the printing substrate web 3 is plotted over the time t given a printing interruption. The printing substrate web 3 is transported with print velocity $G_D$ (segment A1) until a printing interruption should be triggered. The printing substrate web 3 is subsequently braked and brought to a standstill in a slow-down ramp $R_V$ (segment A2). After the printing interruption (segment A3), the printing substrate web 3 is accelerated out of the standstill again in an acceleration ramp $R_B$ to the printing velocity $G_D$ (segment A4).

Since a multitude of vibration oscillations can be executed in one vibration cycle in a prefire measure, a prefire measure can only be implemented when the time period provided for this allows. Whether this is the case depends on the velocity G of the printing substrate web 3. For example, given high velocity G the triggering of a prefire measure can therefore only be reasonable when the velocity G of the printing substrate web 3 has already been partially reduced and the when the time interval of the print clock pulses $T_D$ has reached a predetermined value, for example if the velocity G of the printing substrate web 3 has dropped to 50% of the printing velocity $G_D$ (phase PH1, FIG. 6). Or if the printing substrate web 3 has (for example) not yet reached 50% of the printing velocity $G_D$ in the acceleration ramp $R_B$ (phase PH2, FIG. 6).

Figure 7:
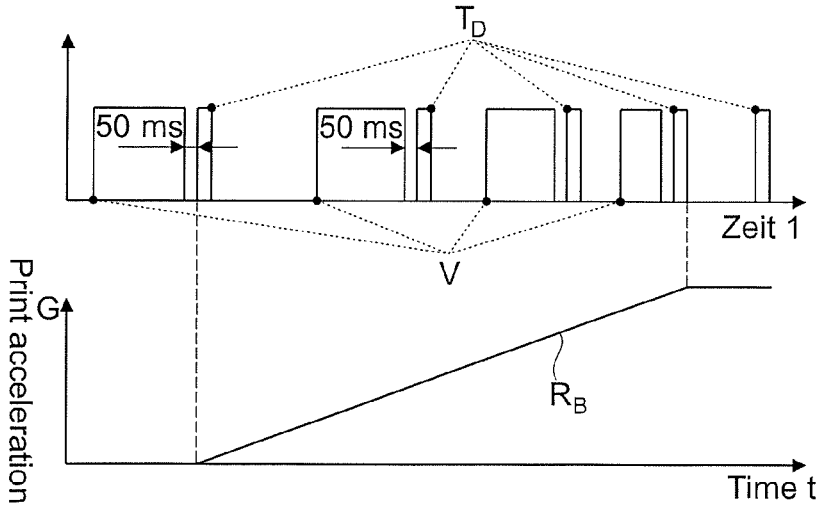
FIG. 7 illustrates the arrangement of prefire cycles in the control data during the velocity ramps in the printing interruption.

For the example of FIG. 6, FIG. 7 shows a series of print clock pulses $T_D$ during an acceleration ramp $R_B$. The time interval becomes increasingly smaller until the printing velocity $G_D$ is achieved. Depending on the velocity during the acceleration ramp $R_B$, the range in which vibration oscillations V can be inserted before print images becomes increasingly smaller, such that the number of vibration oscillations V between the print clock pulses $T_D$ continuously decreases until the relationships at printing velocity $G_D$ have been achieved.

In the example of FIG. 6 and FIG. 7, the information for the insertion of prefire measures are thus derived from the printing velocity $G_D$, while the series of print data and print dots derived from this have not been taken into account.

Figure 8:
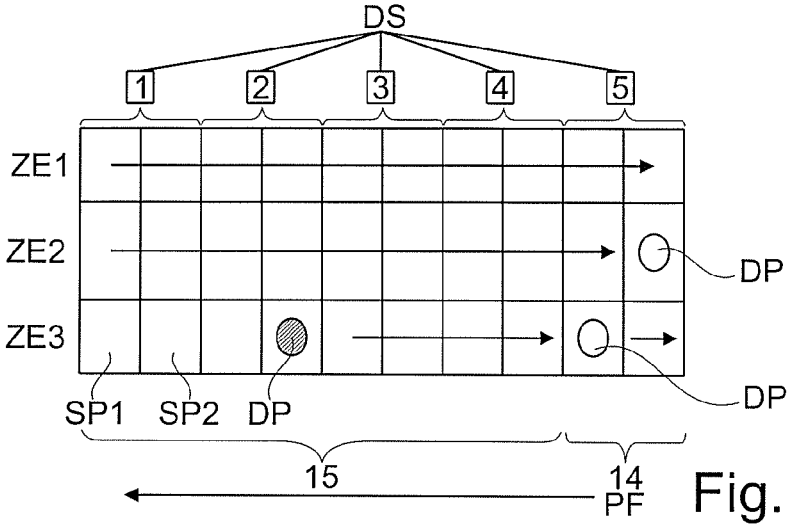
FIG. 8 is an example of the arrangement of print dots across multiple print pages.
Figure 9:
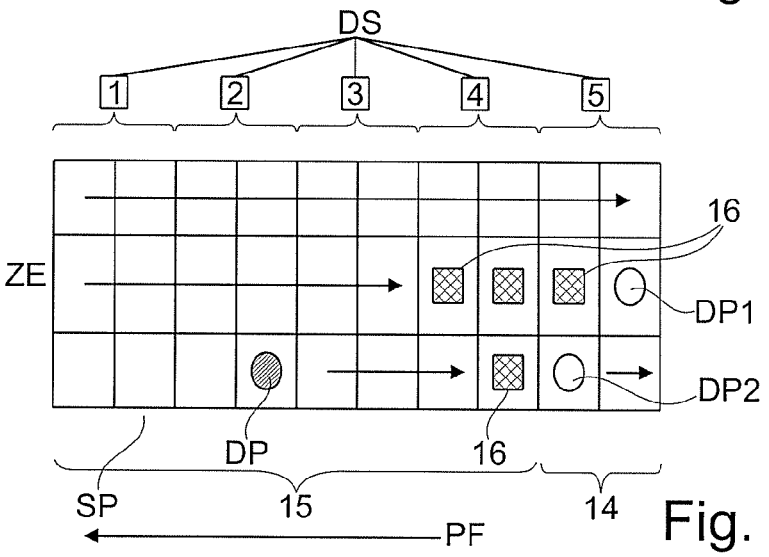
FIG. 9 shows the arrangement of prefire cycles between the print dots given the example of FIG. 8.
Figure 10:
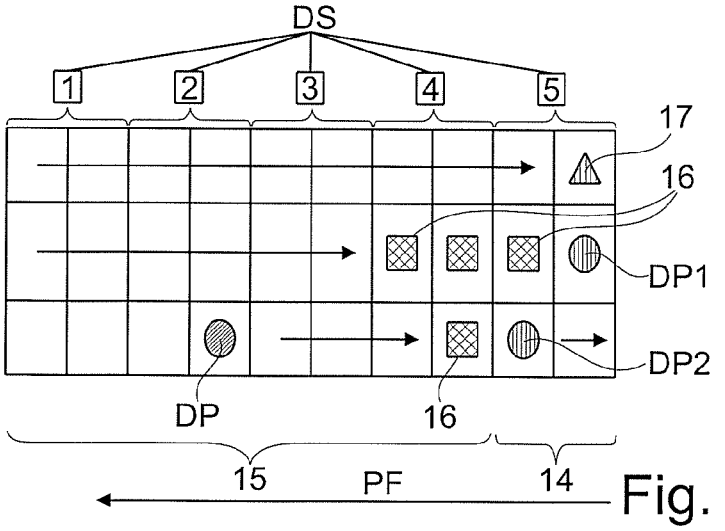
FIG. 10 illustrates the insertion of a refresh measure into the example of FIG. 9.

Third Exemplary Embodiment, FIG. 8 through FIG. 10

Derivation of Prefire Measures and/or Refresh Measures from the Print Data.

Examples for the generation of prefire measures for the example of FIG. 8 result from FIGS. 8 through 10, in which examples schematic print pages DS1 through DS5 respectively comprised of two columns SP1, SP2 and three lines ZE1, ZE2, ZE3 are listed in which it is specified whether a print dot DP is to be implemented on the respective page DS, line ZE and column SP, or whether the page DS should remain unprinted. Furthermore, it is shown whether a prefire measure or refresh measure is to be executed. FIGS. 8 through 10 are subdivided into a region 14 for a current page and a preview region 15; and the print direction PF is moreover indicated. For the page DS2, a print dot DP has been printed in the row ZE3 and column SP2; for the pages DS3 and DS4 no print dots DP are provided; and for the page DS5 a print dot should be printed in line ZE2, column SP2 and line ZE3, column SP1.

In FIG. 9 it is now indicated how prefire measures and/or refresh measures can be provided. From FIG. 9 it results that only prefire measures should be inserted, and in fact respectively before the next print dot DP. For example, three prefire measures 16 can be provided before a print dot DP1 which is preceded by no other print dot DP, while one prefire measure 16 can be provided before a print dot DP2 that is to be printed that is preceded two pages DS before by a print dot DP in a line ZE.

In FIG. 10 it has additionally been drawn how a refresh measure 7 can be provided, for example. In the line ZE1 in which no print dot DP was provided, a refresh measure 17 can be planned in the page in line ZE1, print page DS5.

For example, in the case of FIG. 8, in which a preview of five print pages DS is considered, the following algorithm can thus be derived for a printing element:

- if two print pages DS should lie between one print dot DP generated by a printing element and the next print dot DP to be generated by the printing element, a prefire measure 16 can be inserted before the next dot DP that is to be printed;
- if no print dot DP precedes a dot DP to be printed, three prefire measures 16 can be inserted, for example;
- if no print dot DP should be planned, only one refresh measure 17 can be inserted.

A prefire measure can thereby be composed of at least one vibration cycle with multiple vibration oscillations in which no ink droplets are ejected. A refresh measure can thereby be composed of the firing of ink droplets.

The preparation of print data DD into control data AD according to the method illustrated above can be realized as software in the printer controller 2.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to control in printing elements vibration measures where the printing elements are vibrated but no ink droplets are ejected and refresh measures where ink droplets are ejected through the printing elements to refresh the printing elements in a printing operation of an ink printing system with at least one printing apparatus, the printing apparatus having said printing elements that fire ink droplets as print dots at a printing substrate depending on control data, comprising the steps of:

determining the control data for the printing elements in a preparation process from print data associated with print images, and determining firing pause information about firing pauses for the printing elements indicating that no ink droplets are to be ejected based on the print data;

combining the control data with both prefire data for the vibration measures and refresh data for the refresh measures derived from said firing pause information and from information depending on operating conditions of the printing apparatus; and executing the vibration measures and the refresh measures by the printing elements depending on the firing pause information, the prefire data, and the refresh data.

2. The method according to claim 1 wherein a print job having the print data is developed in a first process step of said process, the print job including information about environment conditions and said operating conditions of the printing apparatus from which the prefire data and the refresh data are derived and that are inserted into the control data.

3. The method according to claim 2 wherein:

with triggering of a printing interruption of the printing operation a feed velocity of a printing substrate is accelerated from a velocity in printing operation to a predetermined velocity in a slow-down ramp, and is accelerated again to said printing velocity in an acceleration ramp after the printing interruption, the prefire data are inserted into the control data depending on the feed velocity of the printing substrate, print clock pulses dependent on feed of the printing substrate are generated with the aid of a sensor, said print clock pulses being supplied to a printer controller, and given occurrence of a print clock pulse during the ramps, the printer controller inducing vibration cycles in the printing elements of the print head depending on the prefire data so that a cycle of vibration oscillations is implemented in said printing elements.

4. The method according to claim 3 wherein a vibration cycle is only generated if a time interval of the print clock pulses relative to one another reaches a predetermined value.

5. The method according to claim 4 wherein during the ramps, a number of vibration oscillations per vibration cycle is set depending on the feed velocity of the printing substrate.

6. The method according to claim 1 wherein:

the process comprises at least first and second process steps, in the second process step a print image raster in which a location at which a print dot is to be applied is associated with a raster point, said location being developed from the print data, and the prefire data or the refresh data inserted into the control data are derived from a series of said print dot locations of one or more successive print images.

7. The method according to claim 1 wherein a number of vibration cycles per printing element for a vibration measure is set depending on a duration of a firing pause for said printing element.

8. A method to control vibration measures and refresh measures in a printing operation of an ink printing system with at least one printing apparatus, the printing apparatus having printing elements that fire ink droplets as print dots at a printing substrate depending on control data, comprising the steps of:

determining the control data for the printing elements in a preparation process from print data associated with print images, and determining firing pause information about firing pauses for the printing elements;

combining the control data with both prefire data for the vibration measures and refresh data for the refresh measures derived from said firing pause information and from information depending on operating conditions of the printing apparatus;

executing the vibration measures and the refresh measures by the printing elements depending on the firing pause information, the prefire data, and the refresh data, no ink droplet being ejected during the vibration measures and ink droplets being ejected during the refresh measures:

wherein at least first and second process steps are provided, in the first process step a print image raster in which a location at which a print dot is to be supplied being associated with a raster point, said location being developed from the print data, and in the second process step the prefire data or the refresh data combined with the control data are derived from a series of said print dot locations of one or more successive print images;

a prefire matrix of said prefire data being formed corresponding to the print image raster;

the print image raster and the prefire matrix being combined with one another, a print dot having priority given a conflict between a print dot location for a print dot and a prefire data; and the control data being formed from a series of the print dot locations associated with the print dots and from the prefire data.

9. The method according to claim 8 wherein:

a refresh matrix of the refresh data is provided in addition to the print image raster and the prefire matrix of the prefire data, the print image raster, the prefire matrix and the refresh matrix being combined with one another, the print dot having priority given a conflict between a print dot location for a print dot and a prefire data, and the control data being formed from a series of print dot locations associated with a print dot, the prefire data, and the refresh data.

10. A method to control vibration measures and refresh measures in a printing operation of an ink printing system with at least one printing apparatus, the printing apparatus having printing elements that fire ink droplets as print dots at a printing substrate depending on control data, comprising the steps of:

determining the control data for the printing elements in a preparation process from print data associated with print images, and determining firing pause information about firing pauses for the printing elements;

combining the control data with both prefire data for the vibration measures and refresh data for the refresh measures derived from said firing pause information and from information depending on operating conditions of the printing apparatus;

executing the vibration measures and the refresh measures by the printing elements depending on the firing pause information, the prefire data, and the refresh data, no ink droplet being ejected during the vibration measures and ink droplets being ejected during the refresh measures;

wherein at least first and second process steps are provided, in the first process step a print image raster in which a location at which a print dot is to be supplied being associated with a raster point, said location being developed from the print data, and in the second process step the prefire data or the refresh data combined with the control data are derived from a series of said print dot locations of one or more successive print images;

the process further comprises a third step; and in the third process step, multiple raster points of the print image raster being merged into raster cells to set grey tones of a print image, said raster cells being filled with print dots depending on the grey tones.

* * * * *